US005671886A

United States Patent [19]

Sesser

[11] Patent Number: 5,671,886

[45] Date of Patent: Sep. 30, 1997

[54] ROTARY SPRINKLER STREAM INTERRUPTER WITH ENHANCED EMITTING STREAM

[75] Inventor: George Sesser, Walla Walla, Wash.

[73] Assignee: Nelson Irrigation Corporation, Walla Walla, Wash.

[21] Appl. No.: 518,492

[22] Filed: Aug. 23, 1995

[51] Int. Cl.[6] ..... B05B 3/08

[52] U.S. Cl. ..... 239/222.21; 239/233

[58] Field of Search ..... 239/222.11–222.19, 239/231–233

[56] References Cited

U.S. PATENT DOCUMENTS

| | | | |
|---|---|---|---|
| Re. 33,823 | 2/1992 | Nelson et al. | 239/222.17 |
| 2,488,234 | 11/1949 | Perry . | |
| 2,592,753 | 4/1952 | Sigmund . | |
| 3,727,842 | 4/1973 | Ertsgaard et al. . | |
| 4,198,000 | 4/1980 | Hunter . | |
| 4,376,513 | 3/1983 | Hagar . | |
| 4,398,666 | 8/1983 | Hunter . | |
| 4,624,412 | 11/1986 | Hunter . | |
| 4,754,925 | 7/1988 | Rubinstein . | |
| 4,805,858 | 2/1989 | Greenberg | 239/253 X |
| 4,817,869 | 4/1989 | Rubinstein . | |
| 4,836,449 | 6/1989 | Hunter . | |
| 4,836,450 | 6/1989 | Hunter . | |
| 4,957,240 | 9/1990 | Rosenberg | 239/233 |
| 4,984,740 | 1/1991 | Hodge . | |
| 5,192,024 | 3/1993 | Blee . | |
| 5,372,307 | 12/1994 | Sesser | 239/231 X |

FOREIGN PATENT DOCUMENTS

| | | | |
|---|---|---|---|
| 2242107 | 9/1991 | United Kingdom | 239/233 |

*Primary Examiner*—Kevin Weldon
*Attorney, Agent, or Firm*—Nixon & Vanderhye P.C.

[57] ABSTRACT

A rotary sprinkler includes a sprinkler body having a center axis and including a nozzle and associated rotor plate for issuing a stream in a substantially radial direction, substantially perpendicular to the axis, and rotating the stream about the center axis; a stream interrupter mounted loosely for eccentric rotation about the center axis, the stream interrupter including an annular ring provided with a plurality of stream deflector fingers, the stream interrupter being driven directly by the stream impinging on the plurality of stream deflector fingers. The rotor plate is formed with a stream emitting groove configured to receive a vertical stream and redirect the stream in the radial direction while also causing the rotor plate to rotate about the center axis. In addition, the groove is profiled to cause the stream to issue from the rotor plate with a primary component and a secondary component diverging from the primary component. This split stream interacts with the stream interrupter to provide greater radius of throw and uniformity characteristics.

17 Claims, 7 Drawing Sheets

ROTARY SPRINKLER STREAM INTERRUPTER WITH ENHANCED EMITTING STREAM

BACKGROUND AND SUMMARY OF THE INVENTION

This invention relates to a rotary sprinkler and, more specifically, to a rotary sprinkler having a stream interrupter driven in a step-wise, eccentric rotational manner by a rotating, split stream emitted from a fixed nozzle and redirected by a grooved rotor plate.

Stream interrupters per se are utilized in the sprinkling art for a variety of reasons. Representative examples as described in the patent literature are found in U.S. Pat. Nos. 5,192,024; 4,836,450; 4,836,449; 4,375,513; and 3,727,842.

One reason for providing stream interrupters is to insure uniformity of the sprinkling pattern. When irrigating large areas with sprinklers, the sprinklers need to be spaced as far apart as possible in order to minimize system costs. To achieve an even distribution of water at wide sprinkler spacings requires sprinklers that simultaneously throw the water a long distance and produce a pattern that "stacks up" evenly when overlapped with adjacent sprinklers. These two requirements are somewhat achieved with a single concentrated stream of water shooting at a relatively high trajectory angle (approximately 24° from horizontal), but this stream by itself produces a "donut" pattern that doesn't stack evenly. Interrupting this concentrated stream, by fanning some of it vertically downwardly produces a more even pattern, but reduces the radius of throw.

The solution to the above problem as disclosed in commonly owned U.S. Pat. No. 5,372,307 (the entirety of which is incorporated herein by reference) involves intermittently interrupting the stream so that at times, the stream is undisturbed for maximum radius of throw, while at other times, it is fanned out to even out the pattern. As disclosed in the '307 patent, the interrupter itself is moved in small rotational increments, so that the interruption points constantly move, thereby resulting in an even distribution of water around the sprinkler, and thereby precluding widely spaced dry "spoke" areas as would be left with a fixed interrupter. More specifically, the '307 patent discloses a self-stepping stream interrupter which is designed for use in a sprinkler of the type where a stream is emitted in a substantially vertical direction from a nozzle fixed in the sprinkler body, which stream thereafter impinges on a groove formed in a rotor plate which redirects the stream radially outwardly. The groove in the rotor plate also has a circumferential component which causes the rotor plate to rotate about its center axis, which also passes through the nozzle. The rotational speed of the rotor plate is slowed by a viscous fluid brake or dampener, so that the stream rotates at a speed of less than about 20 rpm. In this way, both maximum throw and maximum stream integrity are achieved. Absent the interrupter, this sprinkler arrangement would produce the so-called "donut" pattern described above.

The rotor plate is supported on the viscous brake shaft which extends out of a brake housing supported within a sleeve or hub of the sprinkler cap assembly. The cap assembly is (removably) secured to the body of the sprinkler such that the rotor plate groove is located in vertically spaced relationship with, and centered on the axis of the fixed nozzle.

One object of the '307 patent was to take advantage of the maximum throw characteristics achieved by the relatively slow rotation of the rotor plate, and at the same time, to insure a uniform sprinkling pattern extending through a full 360° radially between the sprinkler and the outermost portion of the sprinkling pattern. In the exemplary embodiment described in the '307 patent, a stream interrupter is provided which comprises an annular ring having a plurality of teeth extending radially inwardly from the inner surface of the ring. These interrupter teeth are adapted to partially engage a plurality of teeth formed on an exterior annular surface of the cap assembly hub which supports the rotor plate and associated viscous brake housing.

The interrupter is held loosely supported on a washer so that the interrupter can move axially in opposite directions, but not beyond the teeth on the cap assembly hub. At the same time, the minor diameter of the interrupter teeth is significantly larger than the minor diameter of the hub teeth, so that the interrupter is free to move in several directions, as well as rotationally, when struck by the stream coming off the rotor plate.

The interrupter is also provided with a plurality of depending stream interrupter fingers extending downwardly from the ring. These fingers are shaped as vanes, so that when a finger is struck by the stream, radial, circular, and tilting motions are imparted to the interrupter, as described in greater detail below.

The primary result of the oversized relationship of the interrupter vis-a-vis the hub, is that the interrupter is caused to "walk" around the hub in a step-by-step eccentric manner as the deflector fingers are struck, one at a time, by the stream emitted from the rotor plate. The vane configuration also deflects the stream sideways so that, as the stream rotates with the rotor plate, more and more of the pattern area is wetted so that, ultimately, a uniform sprinkling pattern is achieved throughout the full radial extent of the pattern.

An improvement to the sprinkler construction disclosed in the '307patent is provided by this invention, which results in an increased radius of throw, increased uniformity of sprinkling pattern, and improved stream breakup at low pressures. This enhanced performance is brought about by modifying the stream emitter groove on the rotor plate which, in turn, positively impacts on the interaction between the emitting stream and the stream interrupter fingers.

In the exemplary embodiment, the rotor plate stream emitter groove is modified so that the stream which exits the groove is split into two components; a primary stream, and a slightly smaller secondary stream that is nearly parallel to the primary stream except that it diverges a few degrees to one side of the primary stream. More specifically, the modified rotor plate in accordance with this invention incorporates an open groove having an entry point formed in the rotor plate which is concentric with the center axis of the rotor plate. The groove has an axial depth within the plate, and is curved in the radial direction to provide a circumferential component which causes the rotor plate to rotate about its axis when a stream emitted from the nozzle passes into and through the groove. The groove itself is defined by a base surface and a pair of laterally spaced side walls extending from the base surface. One of the side walls is formed with a pair of ramp surfaces, each extending from the base surface radially outwardly and tapering toward the remote or open end of the side wall. These ramps form wedge-like projections which extend laterally into the groove, with the point of merger of the ramp surfaces with the base surface lying closer to the stream entry point than to the stream exit point.

Similarly, a smaller ramp surface extends radially outwardly and tapers toward the remote or open end of the opposite side wall, thus also forming a smaller wedge-like projection, also extending laterally into the groove in generally the same manner as the wedge-like projections described above. These internal groove surfaces produce a pair of streams in the form of a primary stream and smaller secondary stream, slightly smaller than the first stream.

Impingement of the stream from the fixed nozzle on the modified groove of the rotor plate causes the stream to be redirected radially outwardly in the split stream arrangement described above. When the split stream is between interrupter fingers, it has improved breakup at low operating pressures by reason of the split nature of the stream. As the rotor plate rotates in one direction, the secondary stream is the first part of the split stream to strike an interrupter finger. As the secondary stream hits the finger, it is deflected back toward the primary stream, so that the two streams momentarily knit together into one very tightly concentrated stream. At the same time, the concentrated stream pauses in its rotation due to the combined interaction of the rotating rotor plate and the deflection of the secondary stream off of the diffuser finger. This combination of non-rotation and concentration of the stream apparently causes the combined stream to shoot much further than a continuously rotating single stream. The continued rotation of the rotor plate and further interaction of the split stream with the interrupter fingers fills in the pattern with greater uniformity, as the above described interaction re-occurs as each interrupter finger is engaged by the split stream.

Other sprinkler constructions can incorporate the stream interrupter and stream splitter aspects of the invention. For example, a sprinkler which incorporates a rotating nozzle which redirects the stream to the desired radial outward orientation may also include internal stream splitting surfaces similar to those described above.

In its broader aspects, the invention thus relates to a sprinkler having a nozzle for emitting a stream to atmosphere and including means for rotating the stream and directing the stream in a substantially radially outward direction; a relatively loosely mounted annular stream interrupter surrounding the nozzle and having a plurality of stream interrupter vanes arranged to be struck by the stream, wherein the interrupter vanes have profiles which cause the interrupter to move rotationally in an eccentric manner when struck by the stream, and further wherein the stream is split into a primary component and a secondary component which diverges from the primary component prior to striking the interrupter.

In accordance with another aspect, the invention relates to a sprinkler comprising a sprinkler body having a center axis and including a nozzle adapted to issue a vertical stream along the center axis, and an associated rotor plate for redirecting the stream in a substantially radial direction, substantially perpendicular to the axis while rotating about the center axis; a stream interrupter mounted loosely for eccentric rotation about the center axis, the stream interrupter including an annular ring provided with a plurality of stream deflector fingers, the stream interrupter being driven directly by the stream impinging on the plurality of stream deflector fingers, and wherein the rotor plate is formed with a groove configured to receive the vertical stream and to redirect the stream in the radial direction while also causing the rotor plate to rotate about the center axis, and further wherein the groove is profiled to cause the stream to issue from the rotor plate with a primary component and a secondary component diverging from the primary component.

In still another aspect, the invention relates to a sprinkler having a fixed nozzle for emitting a stream to atmosphere; a rotor plate adapted to redirect the stream radially outwardly, the rotor plate caused to rotate about its own axis by the stream; and a stream interrupter surrounding the axis having a plurality of stream interrupter vanes arranged to be struck by the stream as redirected by the rotor plate, wherein the interrupter vanes have profiles which cause the interrupter to move radially, and rotationally in an eccentric manner when struck by the emitted stream, wherein the rotor plate is formed with a groove shaped to split the stream into a primary component and a secondary component which diverges from the primary component.

In still another aspect, the invention relates to a sprinkler comprising a sprinkler body mounting a fixed nozzle and a cap assembly including a hub supporting a rotor plate for rotation about an axis which passes through the fixed nozzle; the rotor plate having a compound groove formed therein for receiving a stream emitted from the fixed nozzle and for redirecting the stream substantially radially outwardly in two discrete stream portions; and a stream interrupter loosely mounted for eccentric rotation about the hub, the stream interrupter including an annular ring with a plurality of vanes depending therefrom and arranged to be successively struck by the stream exiting the compound groove.

While the stream interrupter of this invention is designed for use with a rotary sprinkler construction as described above, it will be appreciated that the stream interrupter may be applied to any rotary sprinkler that has a single concentrated stream or a substantially concentrated but partially split stream that rotates at a relatively slow speed.

Similarly, the combination of the stream interrupter and modified rotor plate can also be incorporated in other rotary sprinkler constructions.

Other objects and advantages of the invention will become apparent from the detailed description which follows.

DETAILED DESCRIPTION OF THE DRAWINGS

Figure 1:
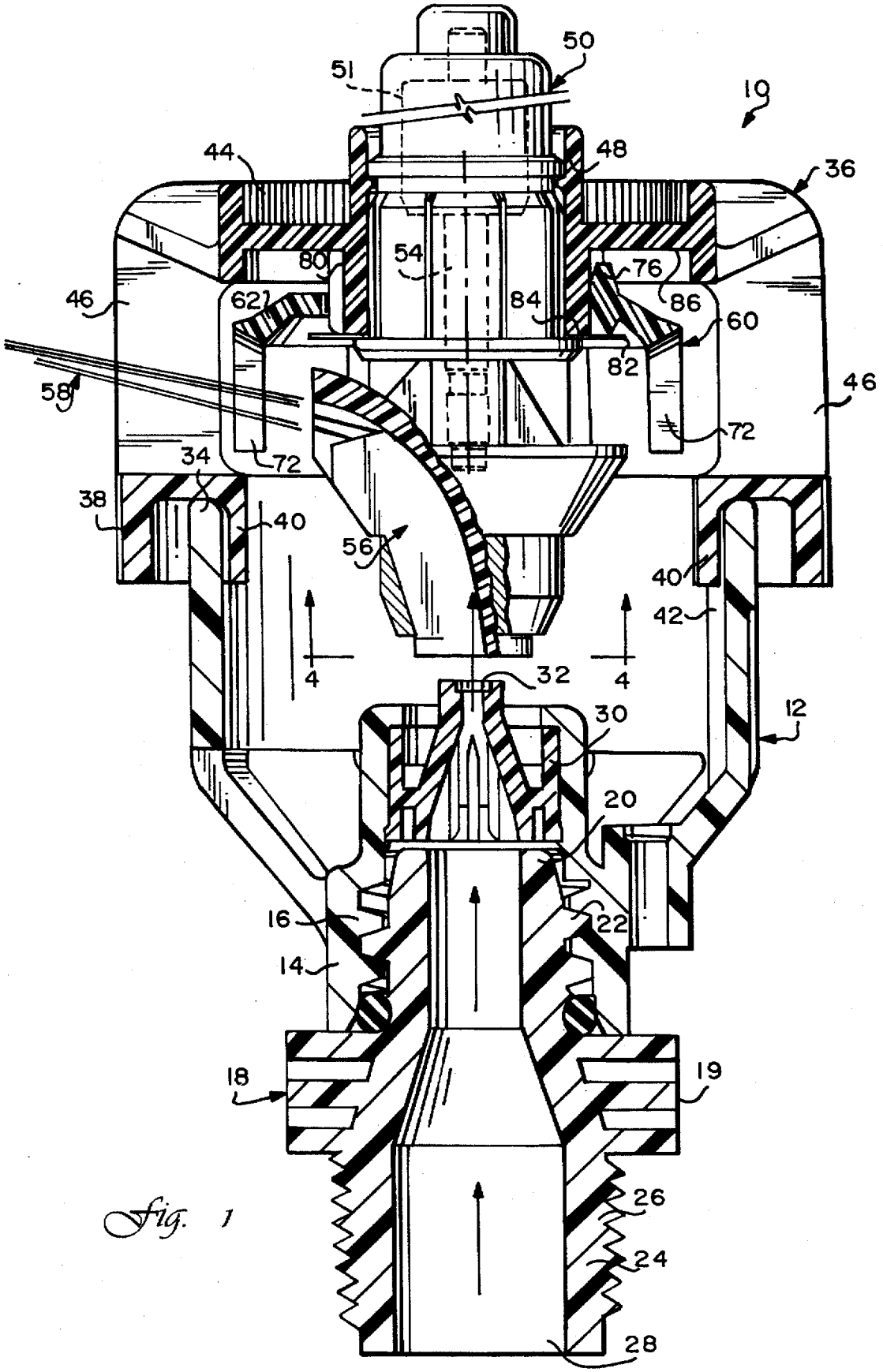
FIG. 1 is a side elevation, partially in section, of a rotary sprinkler incorporating a self-stepping stream interrupter (with several interrupter fingers or vanes removed for clarity) and enhanced stream emitter in accordance with an exemplary embodiment of the invention.
Figure 2:
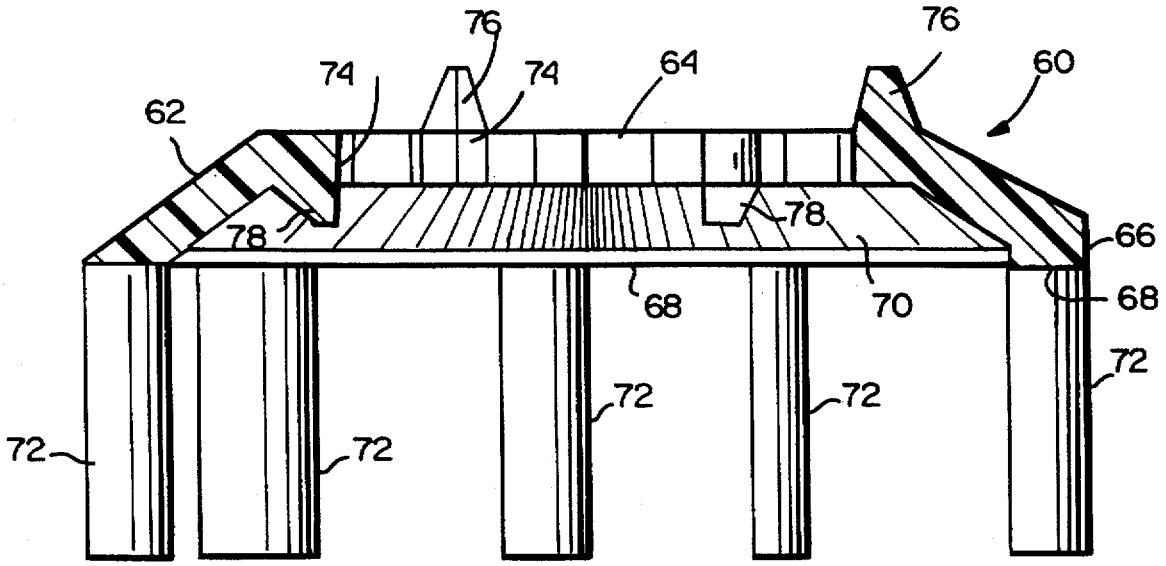
FIG. 2 is a side elevation of a stream interrupter of the type incorporated into the sprinkler construction of FIG. 1 but with several interrupter fingers removed for clarity.
Figure 3:
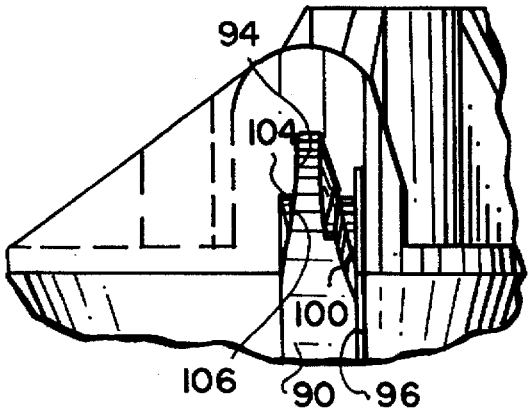
FIG. 3 is a is a partial side elevation of the rotor plate shown in FIG. 1.
Figure 4:
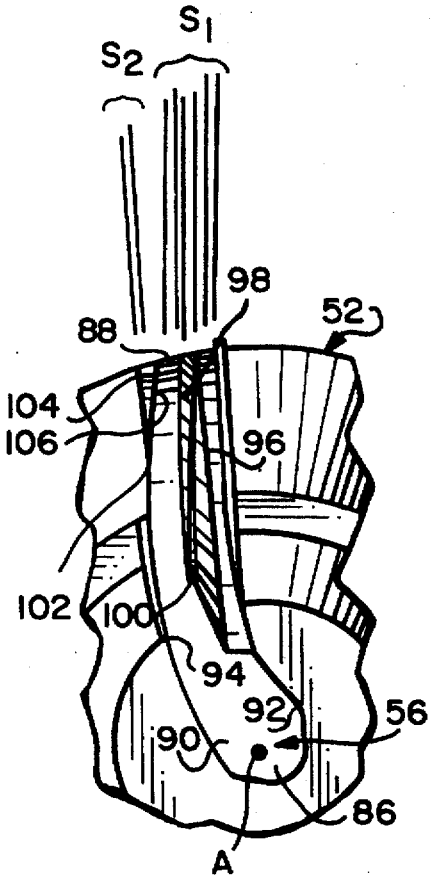
FIG. 4 is a partial section taken along line 4—4 of FIG. 1.
Figure 5:
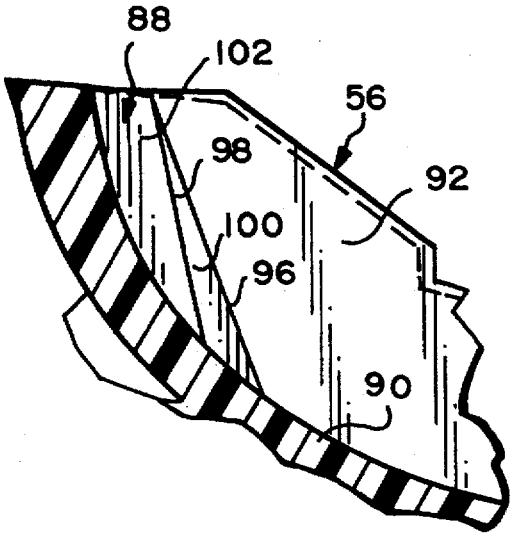
FIG. 5 is a partial side section taken along and inside the rotor plate stream emitter groove, and inverted relative to FIG. 1.
Figure 6:
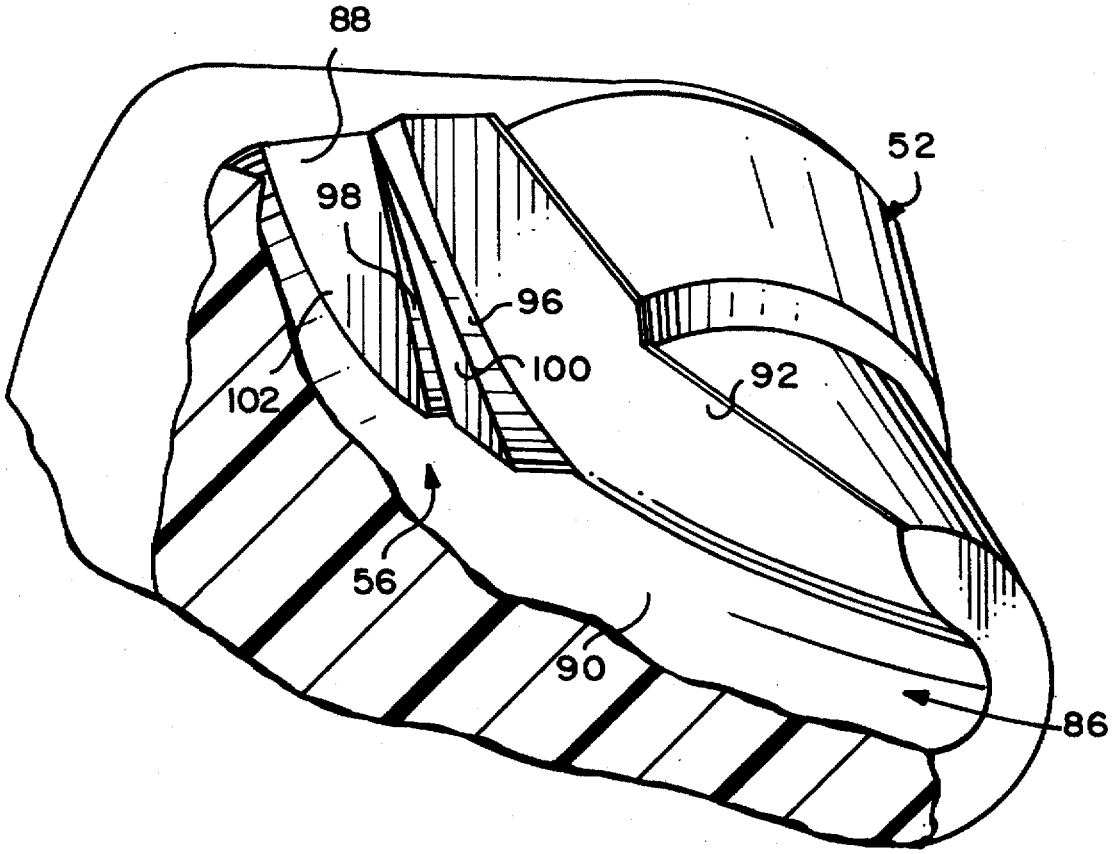
FIG. 6 is a perspective/part section taken along and inside the plate stream emitter groove.

Referring to FIG. 1, a rotator sprinkler 10 includes a sprinkler body 12 having an inlet end 14 provided with an interior screw thread 16 which receives an adaptor 18. The adaptor 18 has a forward end 20 formed with an exterior screw thread 22 adapted to engage the thread 16, and a rearward end 24 which is formed with another exterior screw thread 26 which receive a hose or other coupling. An intermediate portion of the adaptor is provided with flat surfaces 19 which enable rotation of the adaptor by a wrench or similar tool. The adaptor 18 is also formed with an interior through-bore 28 which directs the water supply stream to an axially aligned nozzle 30 secured within the body 12, for discharge (generally vertically upwardly or downwardly along a center axis of the sprinkler) to atmosphere through a fixed nozzle orifice 32.

The sprinkler body 12 is formed with an upper, open end as defined by an annular rim 34 which is adapted to receive a cap assembly 36 in a releasably locked orientation. The cap assembly 36 includes a locking skirt 38, including suitable locking tabs 40 which are designed to resiliently engage lugs (one shown at 42) on the body adjacent the rim 34 so as to releasably hold the cap assembly in place on the sprinkler body. To remove the cap assembly, it is only necessary to squeeze the cap and rotate it to a release position. The manner in which the cap is secured to and released from the sprinkler body, however, forms no part of this invention.

The cap assembly 36 also includes an upper disc 44 supported above the locking skirt 38 by four struts or vanes 46 (two shown), equally spaced about the circumference of the disk 44. The disc 44 includes a centrally oriented hub 48 which frictionally receives (or secures by any appropriate means) a viscous brake or rotor motor 50 in axial alignment with the nozzle 30. The motor 50 mounts a rotor drum 51 via an output shaft 54. The rotor plate 52 is formed with a stream emitting groove generally indicated at 56 which is formed with circumferential component so that when the stream emitted from the nozzle orifice 32 impinges on the groove 56, the rotor plate 52 is caused to rotate about the center axis, along with shaft 54 and the rotor drum 51 located within the rotor motor 50. The specific configuration of groove 56 will be described in greater detail below.

The rotor motor 50 is a viscous fluid brake or dampener of the type disclosed in commonly owned U.S. Pat. Nos. Re. 33,823 and 4,796,811. Thus, the rotor motor or brake is effective to slow the rotation of the rotor plate 52 to a speed of from about ¼ to less than about 20 rpm. In this way, the stream 58 emitted from the sprinkler is not broken up by the speed of the rotor plate, and thus achieves maximum radial throw.

The stream 58 rotates past the stationary upstanding struts or vanes 46, but any dry "spoke" area which might otherwise result from the vanes 46 is substantially negated by the shape of the vanes which causes the stream to deflect slightly in a circumferential direction as it passes over the vanes.

A stream interrupter is shown at 60 which serves to intermittently break up the stream 58 to the extent of facilitating a substantially uniform sprinkling pattern in the radial direction, but without significantly affecting radial throw. In other words, absent the interrupter 60, the slowly rotating split stream 58 would soak an annular area remote from the sprinkler but would leave a substantially dry annular area radially between the sprinkler and the area where the stream strikes the ground (the so-called "donut" pattern). A fixed stream interrupter solves the problem to some extent, but often leaves dry "spokes"extending radially outwardly from the sprinkler. The intermittent rotation of the stream interrupter 60 insures uniformity of sprinkling throughout the pattern area.

Figure 7:
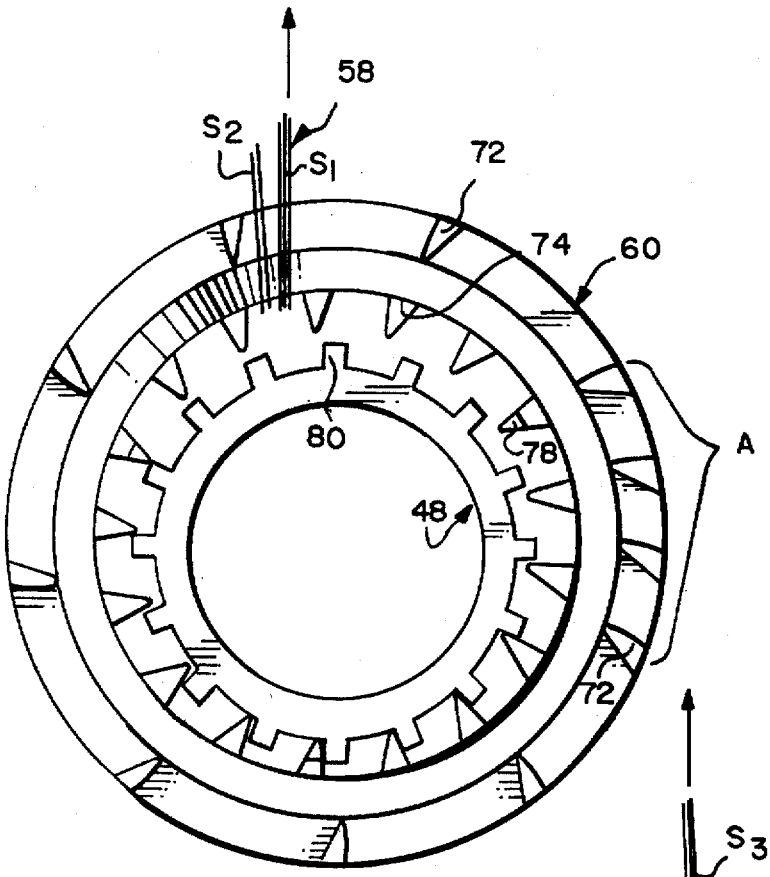
FIGS. 7–9 are bottom elevations (with parts omitted for clarity) illustrating different positions of the stream interrupter as a function of the rotating stream issuing from the rotor plate in accordance with the exemplary embodiment of the invention.
Figure 8:
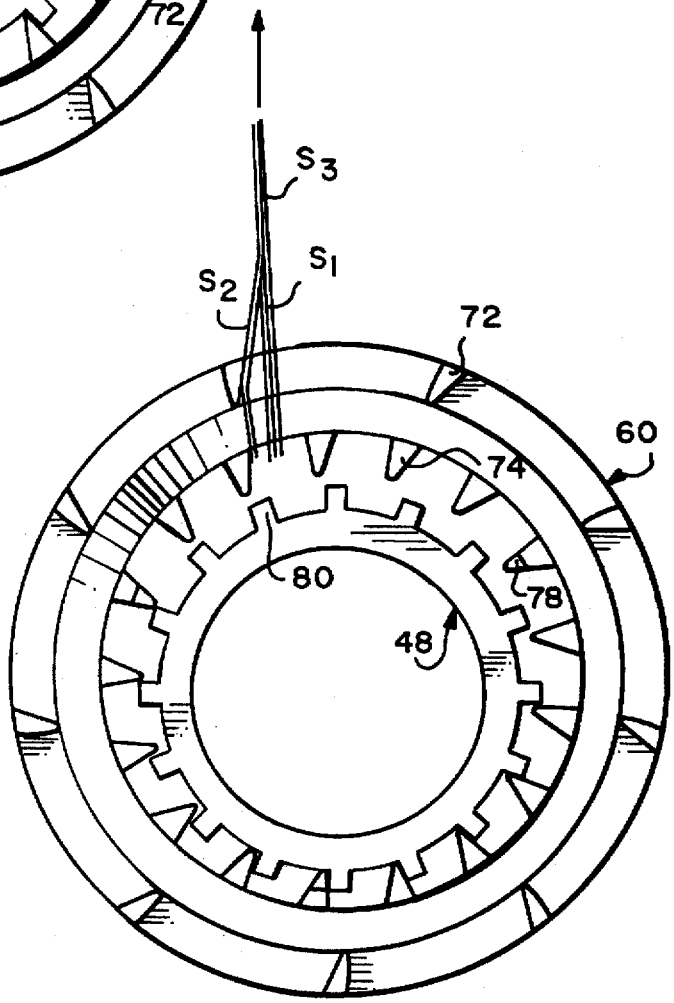
Figure 9:
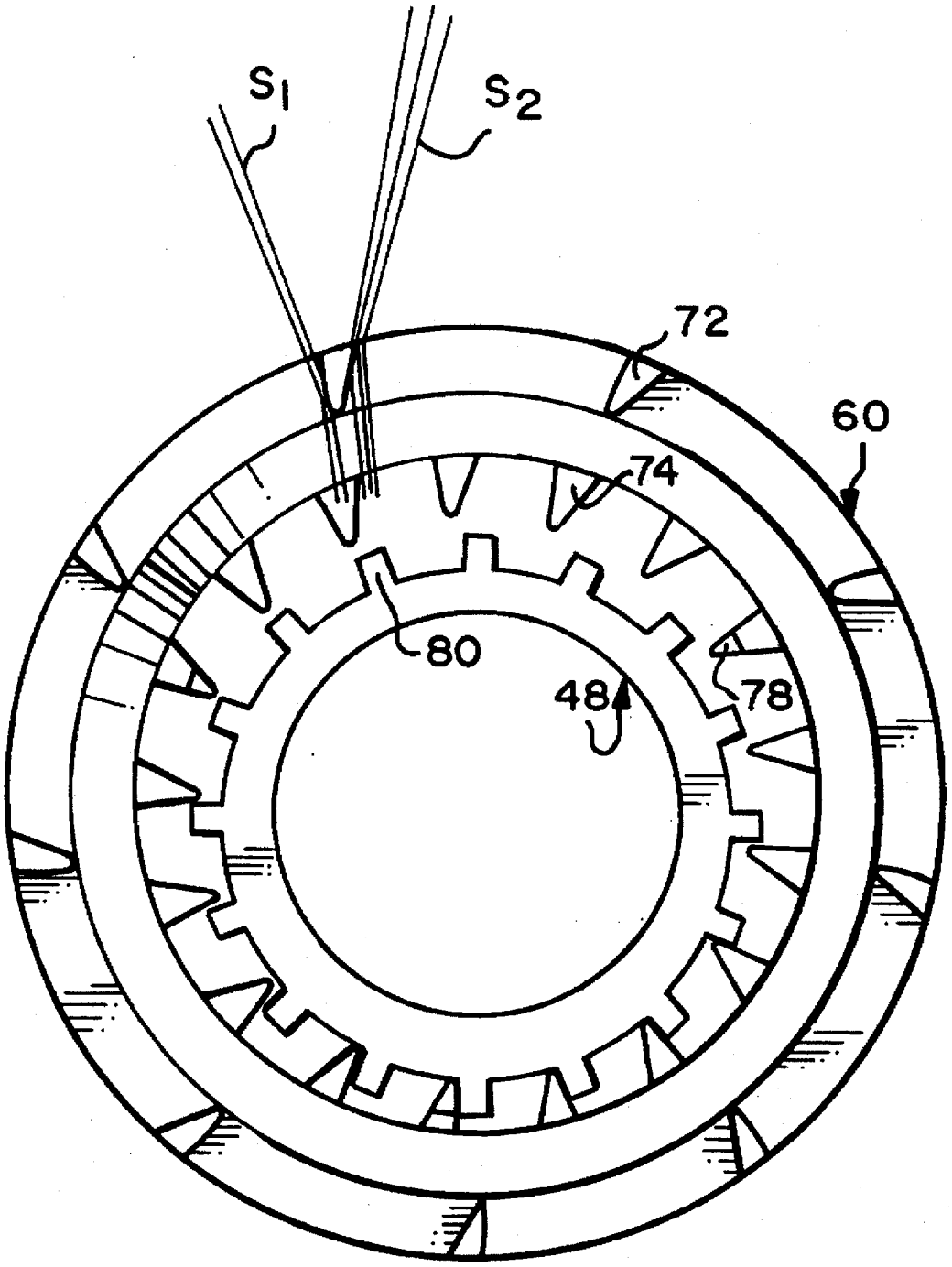

The interrupter 60 is best seen in FIGS. 2 and FIGS. 7–9. The interrupter 60 comprises an annular tapered ring 62 having an inner annular edge 64 defining a center opening, and an outer annular edge 66. The upper surface of the ring 62 tapers downwardly and outwardly between the inner annular edge 64 and the outer annular edge 66. The outer annular edge 66 intersects a lower horizontal edge 68 which, in turn, merges with a lower tapered surface 70 which terminates at the inner annular edge 64. Depending from the lower horizontal edge 68 are a series of axially downwardly extending, vane-shaped interrupter fingers 72. As best seen in FIGS. 7–9, these interrupter fingers are shaped to cause intermittent rotation of the interrupter 60 as the fingers are struck, successively, by the stream 58 as it leaves the rotor plate groove 56, as described further herein. It should be noted that fingers are regularly spaced about the full 360° of the ring 62, with spacing as shown in the area designated A (FIG. 7). In the remaining areas of FIGS. 7 and in FIGS. 8 and 9, fingers 72 have been intermittently removed merely for clarity and convenience. In a preferred example, an interrupter with a diameter of about 1.25 inches has twenty-one vanes or fingers depending therefrom, equally spaced at about 15° increments about the circumference thereof.

A plurality of annular spaced and relatively sharply pointed teeth 74 are formed about the inner annular edge 64 and extend radially inwardly as also best seen in FIGS. 7–9. A few of the teeth 74 (three in the preferred embodiment) are formed with upwardly extending spacers or lugs 76, while the same or other of the teeth 74 (also three in the preferred embodiment) are formed with downwardly extending spacers or lugs 78, the purpose for which will be described below.

With reference again to FIG. 1, as well as to FIGS. 7 through 9, the hub 48 of the cap assembly 36 has an annular exterior surface formed with a plurality of relatively stubby teeth 80, each of which has a substantially rectangular (or square) profile (see FIGS. 7–9).

The number of teeth 80 on the hub 48 (for example, sixteen) is one fewer than the number of teeth 74 on the interrupter 60 (for example, seventeen), and the teeth 80 are designed to partially mesh with the teeth 74 during intermittent rotation of the interrupter 60, as also described below.

A thin washer 82 is supported on a lower flange 84 of the brake housing 50 and this washer, in turn, supports the interrupter 60, as best seen in FIG. 1. Thus, the interrupter 60, while loosely mounted, is generally confined, however, between the underside 86 of the disk 44 and the washer 82.

Returning to FIGS. 7–9, it will be seen that the minor or inner diameter of the interrupter 60 as defined by the radially innermost projections of teeth 74 is considerably larger than the minor or inner diameter of the hub 48 as defined by the radially innermost portions of teeth 80. It will thus be appreciated that the interrupter 60 is loosely secured on the hub and capable of significant (albeit limited) axial, radial and tilting movement relative to the cap assembly 36. At the same time, the interrupter is able to "walk" around the hub 48 eccentrically relative to the axis passing through the nozzle orifice 32 and the rotor plate shaft 54, as described in detail in U.S. Pat. No. 5,372,307. The degree of axial and/or tilting movement of the interrupter is limited by the lugs or spacers 76, 78.

The above described sprinkler construction, with the exception of the improved rotor plate 52, is a commercially available sprinkler, sold under the name R 2000 SERIES ROTATOR, manufactured by the assignee, Nelson Irrigation Corp.

Turning to FIGS. 3–6, the groove 56 in rotor plate 52 in accordance with this invention will now be described in detail. The groove 56 has a stream entry point 86 formed in the rotor plate 52 which is concentric with the axis A of the rotor plate. The groove has an axial depth within the plate, and a circumferential component (best seen in FIG. 4) as the groove extends radially from stream entry point 86 to stream exit point 88, and which causes the rotor plate to rotate about its axis A (FIG. 4) (and the center axis of the sprinkler) when the stream emitted vertically from the nozzle passes into and through the open groove 56. The groove itself is defined primarily by a base wall or surface 90 and a pair of laterally spaced side walls 92, 94.

Side wall 92 is further formed with a pair of ramp surfaces 96, 98, each extending from the base surface 90 or "top" of the groove 56, radially outwardly and tapering toward the open or bottom end of the groove (as viewed in FIG. 1). These ramps form wedge-like projections 100, 102 which project laterally into the groove 56, with the points of merger of the ramp surfaces with base surface 90 lying closer to the stream entry point 86 than to the stream exit point 88.

Similarly, a smaller ramp surface 104 on side wall 94 extends radially outwardly and tapers toward the open or bottom end of groove 56 (see FIGS. 3 and 4), forming a smaller wedge-like projection 106, also laterally projecting into the groove 56, and generally oriented similarly to the above described projections 100, 102.

The above described surfaces internal to the groove 56 result in a pair of streams being emitted substantially radially from the rotor plate 52 including a primary stream $S_1$ and a slightly smaller secondary stream $S_2$. The latter is generally parallel to the former, but angled a few degrees to the left as viewed in FIG. 4.

It will be appreciated that the above described stream splitting groove configuration could be incorporated within, e.g., a conventional gear driven rotating nozzle which itself redirects the stream and thus eliminates the need for a separate rotor plate. Rotation of the nozzle in this case would be controlled by a motor similar to the motor 50 but likely relocated to the sprinkler body. The stream interrupter would then be mounted for rotation by any suitable means.

With reference now to FIGS. 7–9, the interaction between the components $S_1$ and $S_2$ of stream 58 will be described, relative to the interrupter 60. FIG. 7 illustrates the stream components $S_1$ and $S_2$ between interrupter fingers 72, and both leave the sprinkler without interruption (assuming, also, that the stream is between struts 46).

As the rotor plate 52 rotates (more quickly than the interrupter 66 walks about the hub), the secondary stream $S_2$ strikes a finger or vane 72 and is deflected back towards the primary stream $S_1$ (FIG. 8). At this point, two significant events occur:

a) the two streams $S_1$ and $S_2$ momentarily knit together to form one very tightly concentrated stream $S_3$; and b) the concentrated stream $S_3$ pauses in its rotation due to the combined interaction of the rotating rotor plate 52 and the deflection of the secondary stream $S_2$ off the interrupter finger 72.

The impingement of stream $S_2$ on finger 72 also causes a step-like rotation of the interrupter 60, which rotation is continued when the primary stream $S_1$ impinges on the same finger (FIG. 9). Thus, the intermittent, steplike walking of the interrupter 60 continues as the rotor plate 52 rotates at a faster (albeit, slow) speed, distributing the split stream uniformly, with enhanced diffusion (FIG. 9) filling in the pattern.

The combination of non-rotation and concentration depicted in FIG. 8 unexpectedly results in stream $S_3$ shooting farther than the single concentrated stream as described in the '307 patent, and with greater uniformity, as reported in the following comparative examples.

EXAMPLE I

A standard Nelson R2000 sprinkler was mounted on a fixed riser 12"off the ground, under the following conditions:

| | |
|---|---|
| Flow rate (GPM) | 0.89 |
| Nozzle Size | #9 2TN |
| Base Pressure (PSI) | 40.0 |
| Degree of Arc | 360 |

The following results were achieved, with amount of water (inches per hour) shown as a function of radius of throw, in feet.

TABLE I

| Distance in Feet | | | |
|---|---|---|---|
| 1.0' = 0.058 | 9.0' = 0.055 | 17.0' = 0.030 | 25.0' = 0.039 |
| 2.0' = 0.044 | 10.0' = 0.051 | 18.0' = 0.029 | 26.0' = 0.023 |
| 3.0' = 0.045 | 11.0' = 0.049 | 19.0' = 0.028 | 27.0' = 0.006 |
| 4.0' = 0.057 | 12.0' = 0.045 | 20.0' = 0.028 | |
| 5.0' = 0.063 | 13.0' = 0.040 | 21.0' = 0.028 | |
| 6.0' = 0.062 | 14.0' = 0.037 | 22.0' = 0.030 | |
| 7.0' = 0.063 | 15.0' = 0.034 | 23.0' = 0.033 | |
| 8.0' = 0.062 | 16.0' = 0.031 | 24.0' = 0.034 | |

Figure 10:
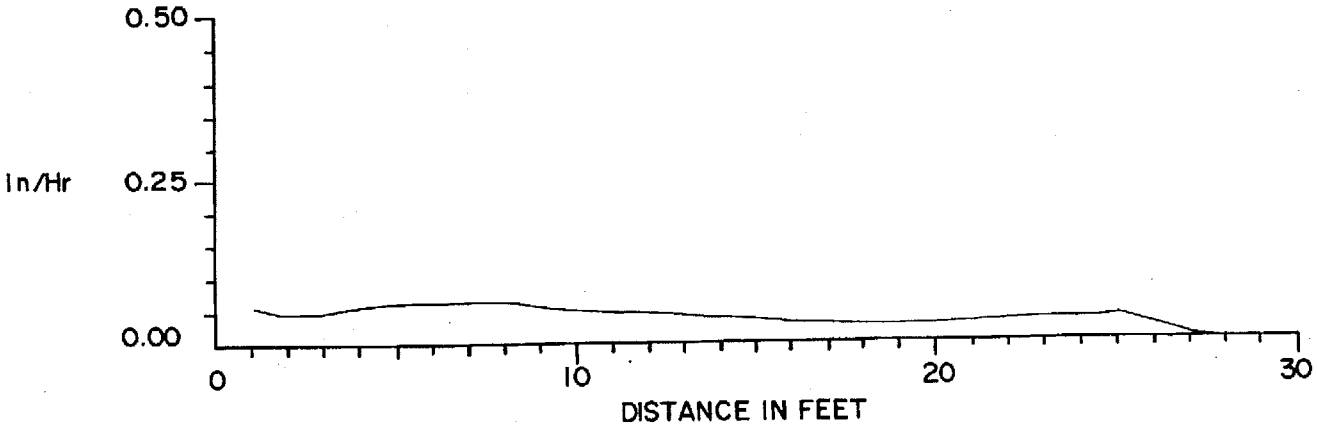
FIG. 10 is a graph illustrating amount of sprinkler water as a function of radius of throw in a first example using a known sprinkler.

The results reported in Table I are shown in graph form in FIG. 10.

A uniformity evaluation of the standard sprinkler configuration as described above, is reported below in Table II.

TABLE II

| | |
|---|---|
| Distr. Uniformity: 87%<br>CU (Christiansen): 88%<br>Sched. Coeff. (5%): 1.2 | Spacing Triangular 24.0' × 20.0' |
| Distr. Uniformity: 80%<br>CU (Christiansen): 89%<br>Sched. Coeff. (5%): 1.3 | Spacing Triangular 26.0' × 22.0' |
| Distr. Uniformity: 80%<br>CU (Christiansen): 85%<br>Sched. Coeff. (5%): 1.3 | Spacing Triangular 28.0' × 24.0' |
| Distr. Uniformity: 79%<br>CU (Cliristiansen): 88%<br>Sched. Coeff. (5%): 2.0 | Spacing Triangular 30.0' × 26.0' |
| Distr. Uniformity: 72%<br>CU (Christiansen): 85%<br>Sched. Coeff. (5%): 1.8 | Spacing Triangular 32.0' × 28.0' |

The uniformity values are based on industry standards where, for the Distribution Uniformity and CU (Christiansen Uniformity), the higher the percent, the greater the degree of uniformity. For the Scheduling Coefficient, a value of 1.0 is perfect, and the closer to 1.0, the better. The second column of Table II reports the spacing between sprinklers in adjacent rows, one row laterally offset relative to the other so that each group of three sprinklers in adjacent rows forms a triangle. Thus, the spacing reported in the first test (24'×20') indicates 24' between two sprinklers in the first row, and 20' between the first and second rows.

EXAMPLE II

Under the same conditions as set forth above, the same sprinkler modified to include a rotor plate 52 of this invention, produced the following results, Table III corresponding to Table I, and Table IV corresponding to Table II.

TABLE III

| Distance in Feet | | | |
|---|---|---|---|
| 1.0' = 0.075 | 9.0' × 0.046 | 17.0' = 0.042 | 25.0' = 0.025 |
| 2.0' = 0.052 | 10.0' = 0.046 | 18.0' = 0.041 | 26.0' = 0.020 |
| 3.0' = 0.048 | 11.0' = 0.046 | 19.0' = 0.042 | 27.0' = 0.019 |
| 4.0' = 0.050 | 12.0' = 0.046 | 20.0' = 0.041 | 28.0' = 0.014 |
| 5.0' = 0.049 | 13.0' = 0.044 | 21.0' = 0.037 | 29.0' = 0.006 |
| 6.0' = 0.047 | 14.0' = 0.042 | 22.0' = 0.035 | |
| 7.0' = 0.047 | 15.0' = 0.042 | 23.0' = 0.031 | |
| 8.0' = 0.048 | 16.0' = 0.042 | 24.0' = 0.028 | |

Figure 11:
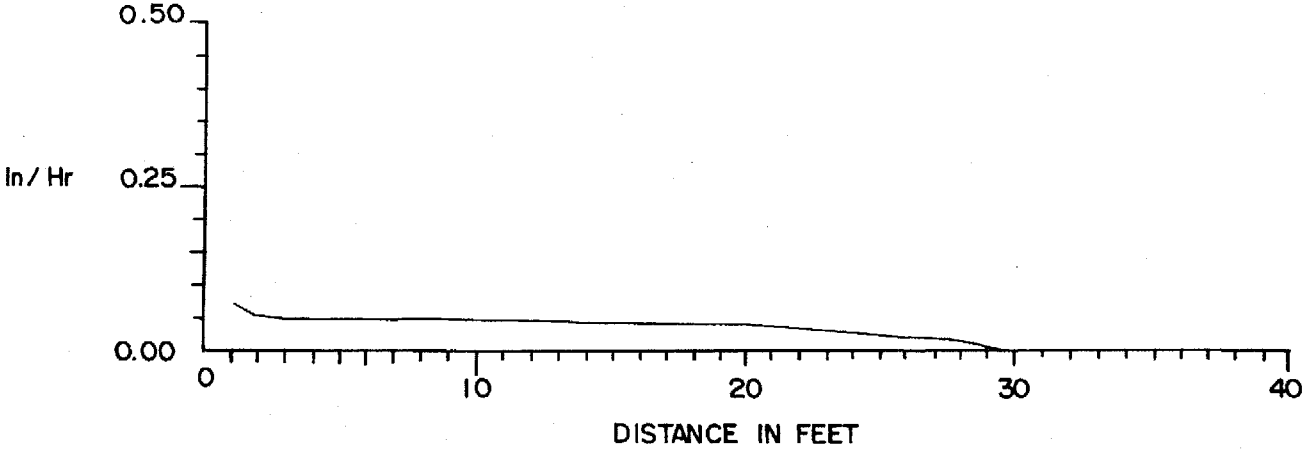
FIG. 11 is a graph illustrating amount of sprinkled water as a function of radius of throw in a second example using the sprinkler in accordance with this invention.

The results indicated in Table III are shown in graph form in FIG. 11.

TABLE IV

| | |
|---|---|
| Distr. Uniformity: 90%<br>CU (Christiansen): 92%<br>Sched. Coeff. (5%): 1.1 | Spacing Triangular 24.0' × 20.0' |
| Distr. Uniformity: 93%<br>CU (Christiansen): 95%<br>Sched. Coeff. (5%): 1.1 | Spacing Triangular 26.0' × 22.0' |
| Distr. Uniformity: 93%<br>CU (Christiansen): 95%<br>Sched. Coeff. (5%): 1.1 | Spacing Triangular 28.0' × 24.0' |
| Distr. Uniformity: 83%<br>CU (Christiansen): 91%<br>Sched. Coeff. (5%): 1.5 | Spacing Triangular 30.0' × 26.0' |
| Distr. Uniformity: 74%<br>CU (Christiansen): 86%<br>Sched. Coeff. (5%): 1.8 | Spacing Triangular 32.0' × 28.0' |

The results show unexpectedly improved radius of throw, increasing from just over 27' to more than 29' (about 7.4%) and improved uniformity (by all measures, and under various spacing arrangements) for the sprinkler incorporating the modified rotor plate 56. The observed improvements, in turn, permit fewer sprinklers per acre. Accordingly, the present invention incorporates all of the advantages of the sprinkler disclosed in the '307 patent, and also significantly improves the performance of that sprinkler by reason of the unique rotor plate stream distributing groove described herein.

While the invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope of the appended claims.

What is claimed is:

1. A sprinkler comprising a sprinkler body having a center axis and including a nozzle adapted to issue a vertical stream along said center axis, and an associated rotor plate for redirecting the stream in a substantially radial direction, substantially perpendicular to said axis while rotating about said center axis; a stream interrupter mounted loosely for eccentric rotation about said center axis, said stream interrupter including an annular ring provided with a plurality of stream deflector fingers, said stream interrupter being driven directly by said stream impinging on said plurality of stream deflector fingers, and wherein said rotor plate is formed with a groove configured to receive the vertical stream and to redirect the stream in said radial direction while also causing the rotor plate to rotate about said center axis, and further wherein said groove is profiled to cause the stream to issue from the rotor plate with a primary component and a secondary component diverging from said primary component, and further wherein said primary and secondary stream components are arranged such that the secondary stream engages a respective one of said stream deflector fingers before the primary stream, and is deflected back into the primary stream to form a third concentrated stream.

2. The sprinkler of claim 1 wherein said groove comprises a base surface and a pair of side walls, said side walls each formed with at least one wedge-shaped projection extending radially outwardly and away from said base surface.

3. The sprinkler of claim 1 and further including a hub formed with a first plurality of teeth about an exterior annular surface thereof, and wherein said stream interrupter comprises a ring having a second plurality of teeth extending radially inwardly from said ring, only some of said first and second pluralities of teeth being in meshing engagement at any given time, and wherein said second plurality of teeth exceeds said first plurality of teeth by one, so that said interrupter is rotated in a stepwise eccentric manner about said hub.

4. The sprinkler of claim 3 wherein at least one set of said first and second plurality of teeth have a substantially pointed profile.

5. The sprinkler of claim 3 wherein, at any given time, a majority of said second plurality of teeth are not engaged by any of said first plurality of teeth.

6. The sprinkler of claim 3 wherein said first and second plurality of teeth are configured for loosely meshing engagement so as to prevent dirt and debris from jamming said interrupter.

7. The sprinkler of claim 3 wherein said interrupter has a plurality of upstanding lugs on said ring; and further wherein said interrupter has a plurality of depending lugs on said ring.

8. The sprinkler of claim 1 wherein said rotor plate is mounted on one end of a shaft, the other end of the shaft received in a viscous braking device for slowing rotational speed of said rotor plate.

9. A sprinkler comprising a sprinkler body having a center axis and including a nozzle adapted to issue a vertical stream along said center axis, and an associated rotor plate for redirecting the stream in a substantially radial direction, substantially perpendicular to said axis while rotating about said center axis; a stream interrupter mounted loosely for eccentric rotation about said center axis, said stream interrupter including an annular ring provided with a plurality of stream deflector fingers, said stream interrupter being driven directly by said stream impinging on said plurality of stream deflector fingers, and wherein said rotor plate is formed with a groove configured to receive the vertical stream and to redirect the stream in said radial direction while also causing the rotor plate to rotate about said center axis, and further wherein said groove is profiled to cause the stream to issue from the rotor plate with a primary component and a secondary component diverging from said primary component, and further wherein said primary and secondary stream components are arranged such that the secondary stream engages a respective one of said stream interrupter vanes before the primary stream, and is deflected back into the primary stream to form a third concentrated stream.

10. The sprinkler of claim 9 wherein said groove comprises a base surface and a pair of side walls, said side walls each formed with at least one wedge-shaped projection extending radially outwardly and away from said base surface.

11. The sprinkler of claim 9 and further including a hub formed with a first plurality of teeth about an exterior annular surface thereof, and wherein said stream interrupter comprises a ring having a second plurality of teeth extending radially inwardly from said ring, only some of said first and second pluralities of teeth being in meshing engagement at any given time, and wherein said second plurality of teeth exceeds said first plurality of teeth by one, so that said interrupter is rotated in a stepwise eccentric manner about said hub.

12. The sprinkler of claim 9 wherein said rotor plate is mounted on one end of a shaft, the other end of the shaft received in a viscous braking device for slowing rotational speed of said rotor plate.

13. A sprinkler comprising a sprinkler body mounting a nozzle and a cap assembly including a hub supporting a rotor plate for rotation about an axis which passes through said nozzle; said rotor plate having a compound groove formed therein for receiving a stream emitted from said nozzle and for redirecting the stream substantially radially outwardly in two discrete stream portions; and a stream interrupter loosely mounted for eccentric rotation about said hub, said stream interrupter including an annular ring with a plurality of vanes depending therefrom and arranged to be successively struck by said stream portions exiting the compound groove such that said two discrete stream portions are combined to form a third concentrated stream.

14. The sprinkler of claim 12 wherein said rotor plate is mounted on a first end of a shaft; and further wherein a viscous braking device including a housing is supported within said cap assembly, and a second end of said shaft is mounted within said housing of said viscous braking device.

15. The sprinkler of claim 14 wherein a rotor is fixed to said second end of said shaft within said housing, and wherein said housing contains a viscous fluid.

16. A sprinkler having a nozzle for emitting a stream to atmosphere and including a rotor plate having a groove configured to rotate the stream and to direct the stream in a substantially radially outward direction; a relatively loosely mounted annular stream interrupter surrounding said nozzle and having a plurality of stream interrupter vanes arranged to be struck by the stream, wherein said interrupter vanes have profiles which cause said interrupter to move rotationally in an eccentric manner when struck by the stream, and further wherein said groove is further configured so that said stream is split into a primary component and a secondary generally parallel component prior to striking said interrupter, wherein said groove is configured so that the secondary stream engages a respective one of said stream interrupter vanes before the primary stream, and is deflected back into the primary stream to form a third concentrated stream.

17. The sprinkler of claim 16 and further including a hub formed with a first plurality of teeth about an exterior annular surface thereof, and wherein said stream interrupter comprises a ring having a second plurality of teeth extending radially inwardly from said ring, only some of said first and second pluralities of teeth being in meshing engagement at any given time, and wherein said second plurality of teeth exceeds said first plurality of teeth by one, so that said interrupter is rotated in a stepwise eccentric manner about said hub.

* * * * *